US006063415A

United States Patent [19]

Walters

[11] Patent Number: 6,063,415

[45] Date of Patent: May 16, 2000

[54] MICROWAVEABLE FOOD CONTAINER AND METHOD OF USING SAME

[75] Inventor: Candace Mary Walters, Arlington Heights, Ill.

[73] Assignee: Kraft Foods, Inc., Northfield, Ill.

[21] Appl. No.: 09/234,686

[22] Filed: Jan. 21, 1999

[51] Int. Cl.[7] ..... A23B 4/00

[52] U.S. Cl. ..... 426/107; 426/113; 426/122; 426/234; 229/109; 229/122; 206/738; 206/784

[58] Field of Search ..... 426/107, 113, 426/114, 115, 122, 123, 243, 234, 412; 206/784, 804, 738; 229/240, 227, 122, 110, 109

[56] References Cited

U.S. PATENT DOCUMENTS 4,844,330 7/1989 Roosa et al. ..... 229/120.06
5,351,880 10/1994 Goudreau ..... 229/120.32

*Primary Examiner*—Nina Bhat
*Assistant Examiner*—Sherry A. Dauerman
*Attorney, Agent, or Firm*—Fitch, Even, Tabin & Flannery

[57] ABSTRACT

A food container and its method of use are disclosed. The food container includes a top panel, bottom panel and plurality of sidewalls. A movable panel is hingedly connected to one of the sidewalls, allowing a consumer to open the container. Attached to the lower edge of the movable panel is a shelf supporting a food item. A consumer can access the food item by opening the movable panel, which causes the shelf to carry the food item outside the container into a position that permits the consumer to easily manipulate it. The food item or a portion thereof can then be replaced in the container by simply closing the movable panel. The shelf may engage one or more sidewalls of the bottom panel to assist in maintaining the container in a closed position after initial opening and reclosing. The container is suitable for packaging food items that include both microwaveable and non-microwaveable ingredients. A foldable blank for manufacturing the container is also disclosed.

19 Claims, 4 Drawing Sheets

MICROWAVEABLE FOOD CONTAINER AND METHOD OF USING SAME

TECHNICAL FIELD OF THE INVENTION

The present invention relates generally to food containers, and more particularly, to a microwaveable food container.

BACKGROUND OF THE INVENTION

In providing a container for commercial packaging of food products, among the considerations that must be addressed are the ability of the container to receive the product in packaging operations, the degree of difficulty that will be encountered by the consumer in removing the product from the container, and the ability of the container to withstand various loads during filling, sealing, shipping, display and consumer use, without being damaged or unduly distorted or disfigured. Containers for food products must be capable of maintaining a closed, sealed configuration and an undamaged appearance until opened by the consumer. Even if the container is functionally intact, an appearance that the container is damaged or that it is not properly closed and sealed may make the product unacceptable to consumers.

Containers for consumer food products must also be capable of being opened without undue difficulty. Packaging which does not require the use of a knife, scissors, or other sharp implements can provide a significant advantage in the marketplace.

Microwaveable packaging must satisfy additional criteria. Packaging that is required to hold food products during microwave cooking may need to withstand short term exposure to microwave radiation, heat, steam, and/or hot water while maintaining a required degree of strength and rigidity, and without being subject to arcing, delamination, loss of integrity, or melting. In addition, microwaveable packaging may be required to contain one or more reflectors, shields, susceptors, or other elements intended to affect the cooking process.

Another significant consideration is that, in some cases, the food product is to be removed from the packaging prior to cooking, then replaced after removing a portion of the food product or the packaging. Thus, in some cases, the packaging must be capable of initial opening, reclosing, and reopening. Ease of use with respect to each of these steps can provide a package with a significant advantage.

It is a general advantage of the invention to provide a microwaveable container for consumer packaging of microwaveable food products which satisfies the above discussed criteria, and which offers enhanced capabilities with respect to initial opening, reclosing and reopening.

SUMMARY OF THE INVENTION

The invention provides a novel and improved microwaveable container for microwaveable food products having a movable support to facilitate handling of food products by the consumer. In particular, the container facilitates initial opening of the container, removal and replacement of one or more food items, and employment of the container as a holder for the food product(s) during cooking in a microwave oven, and removal of the food product(s) after cooking. The container may be particularly useful in the context of multiple-component food products, wherein one or more components is intended to be cooked, and one or more other components is not intended to be cooked, by facilitating selective removal and/or replacement of individual components.

The movable support may be a shelf which overlies the bottom panel of the container in frictional engagement therewith so that, after initial opening and reclosing, the weight of the food product on the shelf maintains the container in a closed position. Also, the shelf may have an edge portion which engages one or more sidewalls to aid in maintaining the container in a closed configuration after reclosing.

In the preferred embodiment of the invention, the food container includes a top panel, a bottom panel, and a plurality of sidewalls. A movable panel is hingedly connected to one of the sidewalls, allowing a consumer to open the container.

In the preferred embodiment of the invention, the food container includes a top panel, a bottom panel, and a plurality of sidewalls. A movable panel is hingedly connected to one of the sidewalls, allowing a consumer to open the container. Attached to the lower edge of the movable panel is a movable support for supporting a food item. A consumer can access the food item by opening the movable panel, which in turn causes the movable support to carry the food item outside the container into a position that permits the consumer to easily separate any non-microwaveable ingredients. The microwaveable portion can then be replaced in the container by simply closing the movable panel. After heating the enclosed food, the consumer can easily withdraw the heated microwaveable portion by again manipulating the movable panel.

The present invention also provides a foldable blank for inexpensively constructing a container as described above, and a unique method of preparing a food item packaged in the container.

DETAILED DESCRIPTION OF THE PREFERRED EMBODIMENT

The invention is generally embodied in a food container and in a method of preparing a food product packaged in the container.

Figure 1:
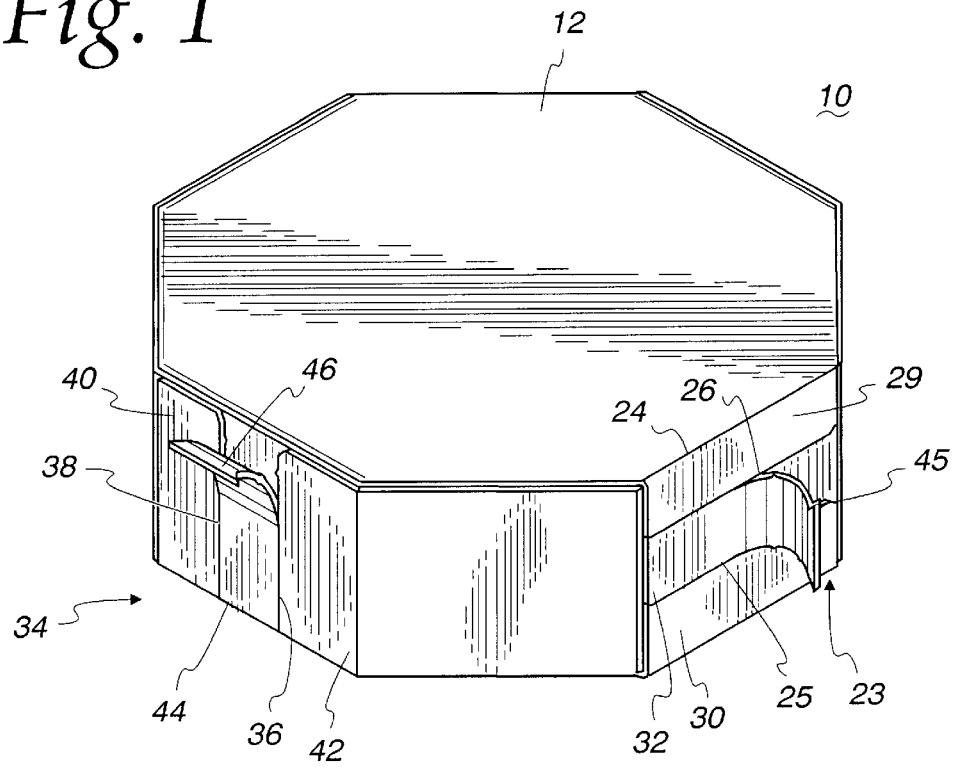
FIG. 1 is a perspective view of a food container in accordance with a first embodiment of the present invention.
Figure 2:
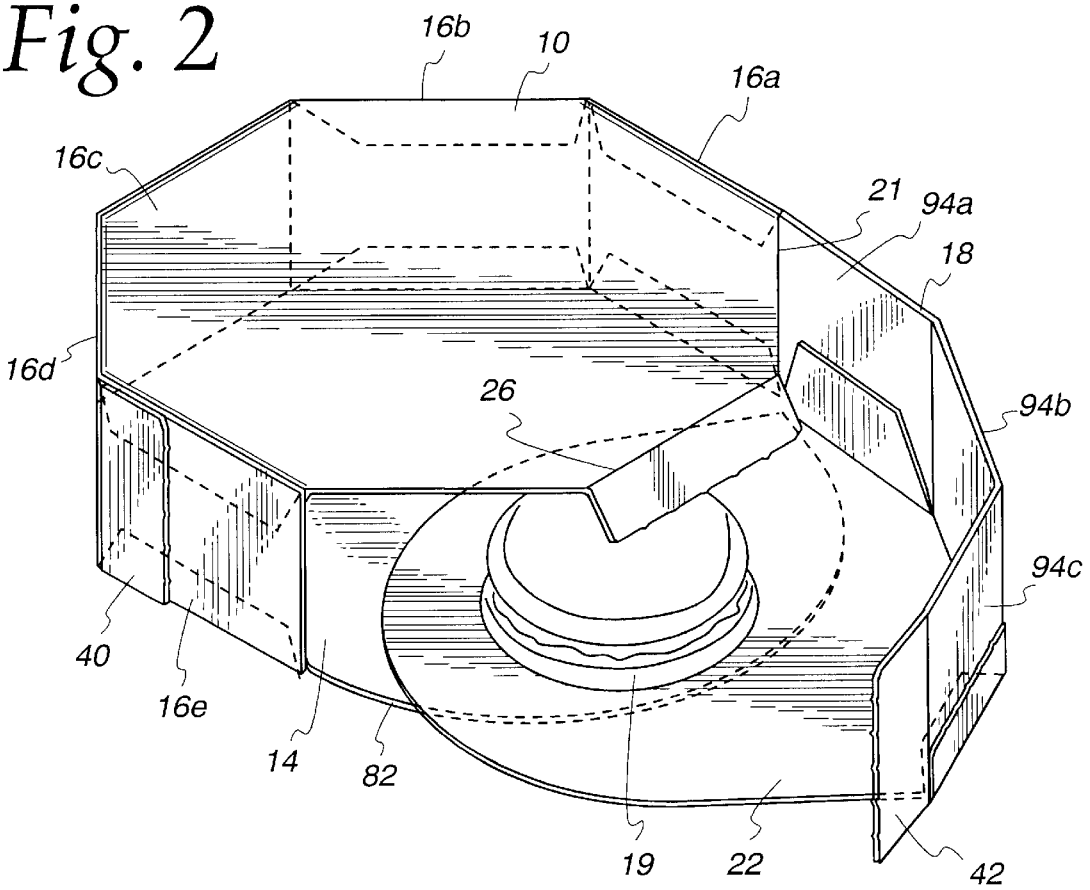
FIG. 2 is a perspective view of the food container of FIG. 1 shown in an open position.

Referring now to the drawings, and more particularly, to FIGS. 1 and 2, there is illustrated a food container 10 that conforms to a first embodiment of the present invention. The container 10 is preferably made of paperboard material or another material having sufficient strength, stiffness and durability to withstand loads associated with shipping, handling, etc., in commercial use. The container is also preferably capable of withstanding exposure to microwave radiation, heat, steam, and hot water during microwave cooking of a food product contained therein. In FIG. 1, the food container 10 is shown in the closed position; while in FIG. 2 it is shown in an open position. The food container 10 includes an octagonal top panel 12 and a generally polygonal bottom panel 14, which is substantially parallel to the top panel 12. The container 10 also includes a plurality of sidewalls 16*a–e* attached between the top and bottom panels 12–14. A movable panel 18 is hingedly connected to an end 20 of one of the side panels 16*a*. Projecting from the lower edge of the movable panel 18 toward the interior of the container 10 is a movable support which may be a shelf 22 for supporting a food item 19. The shelf 22 is slidable over the upper surface of the bottom panel 14 as the movable panel 18 is moved between the open and closed positions.

The movable panel 18 is retained in the closed position by two tear strips 32, 44. The tear strips are included in two adhering flaps 23, 34. The first adhering flap 23 is joined to the top panel 12 at fold line 24. The flap 23 includes a pair of weakening lines 25, 26 which divide the flap 23 into an upper panel portion 29 and a lower panel portion 30 with the area between the weakening lines 25, 26 being the tear strip 32. An adhesive can be disposed upon the lower portion 30 for adhering the same to the lower exterior surface of the movable panel 18.

The second adhering flap 34 is located at the unhinged end of the movable panel 18. The flap 34 includes a pair of vertical weakening lines 36, 38 that divide the flap 34 into an adhering portion 40 and an inner portion 42 with a vertical tear strip 44 between the weakening lines 36, 38. An adhesive disposed upon the interior surface of the adhering portion 40 can be used to secure the same to the exterior surface of the sidewall 16*e*.

To remove the food item 19 from the interior of the container 10, the horizontal tear strip 32 is grasped at its end 45, and a pulling force applied thereto severs the same along the weakening lines 25, 26 in a manner as shown in FIG. 1. The vertical tear strip 44 is removed in a similar manner. The tear strip 44 is grasped by its upper end 46 and a pulling force is applied to sever the strip 44 along the weakening lines 38, 36. Upon removal of the tear strips 32, 44 the movable panel 18 is free to hinge or pivot laterally as viewed in FIG. 2, about the sidewall end 20.

Once the container 10 is opened, the food item 19 can be manipulated by the consumer. For instance, with the panel 18 in the open position as shown in FIG. 2, the consumer can easily separate microwaveable and non-microwaveable portions of the food item 19. After separating the ingredients, the microwaveable portion can be conveniently enclosed in the container 10 by simply closing the movable panel 18. Replacing the food in the container 10 prior to heating greatly reduces the cooking time, as well as the possibility of mess caused by spattering.

The shelf 22 can overlie the bottom panel 14 of the container 10 in frictional engagement therewith so that, after initial opening and reclosing, the weight of the food product on the shelf 22 maintains the container 10 in a closed position. Also, the shelf 22 may have an edge portion which engages one or more sidewalls to aid in maintaining the container in a closed configuration after reclosing.

Figure 3:
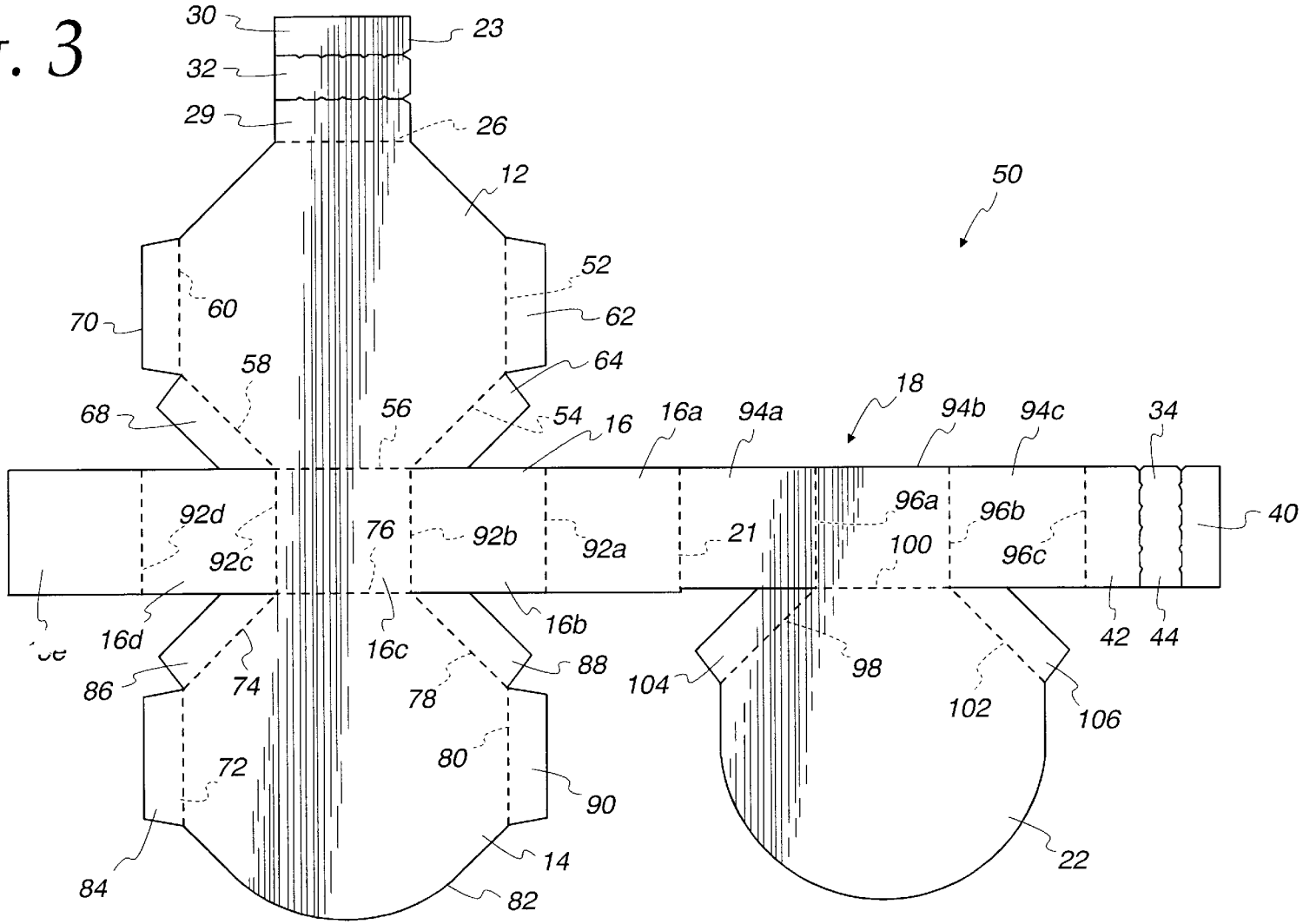
FIG. 3 is a top plan view of the blank from which the container of FIGS. 1–2 is constructed.

Referring now to FIG. 3, a blank 50 is shown which can be used to form the container 10 of FIGS. 1 and 2. The blank 50 is illustrated as a sheet of material, such as cardboard, defining the top panel 12, which is set off by fold lines 52, 54, 56, 58, and 60 to impart an octagonal shape thereto. Four flanges 62, 64, 68, and 70 are joined to the top panel 12 by the respective fold lines 52–60. In constructing the container, adhesive is disposed upon the flanges 62–70 to attach them to the upper interior surfaces of the respective sidewalls 16*a–b*, 16*d–e*.

The bottom panel 14 is set off by fold lines 72, 74, 76, 78, and 80, which impart a generally polygonal shape thereto. The bottom panel 14 includes a curved edge 82 that extends toward the opening of the container 10. Four flanges 84, 86, 88, and 90 are joined to the bottom panel 14 by the respective fold lines 72–80. In constructing the container 10, the bottom flanges 84–90 are attached to the lower interior surfaces of the side panels 16*a–b*, 16*d–e* using an adhesive disposed thereupon.

The middle sidewall 16*c* is joined to the top and bottom panels 12, 14 at fold lines 56, 76. The sidewalls 16*a–e* are set off from each other by fold lines 92*a–d*.

The movable panel 18 is joined to the sidewall 16a by the fold line 21. The fold line 21 can be formed in a manner to produce a living hinge, which allows the movable panel 18 to axially pivot about the fold line 21. The movable panel 18 includes a plurality of vertical panels 94*a–c* being set off by fold lines 96*a–c*. To permit a flush fit with the container body when the movable panel 18 is in the closed position, the vertical panels 94*a–c* have a vertical height that is slightly less than that of the sidewalls 16*a–e*.

The slidable shelf 22 has a generally polygonal shape that is set off by fold lines 98, 100, 102. Flanges 104 and 106 are joined to the slidable shelf 22 at the respective fold lines 98, 102. The slidable shelf is joined to the middle vertical panel 94*b* at fold line 100. An adhesive can be disposed on the flanges 104, 106 permitting them to be attached to the lower inner surface of the vertical panels 94*a, c*. This allows the slidable shelf 22 to maintain a substantially normal relationship to the vertical panels 94*a–c* of the movable panel 18.

Figure 4:
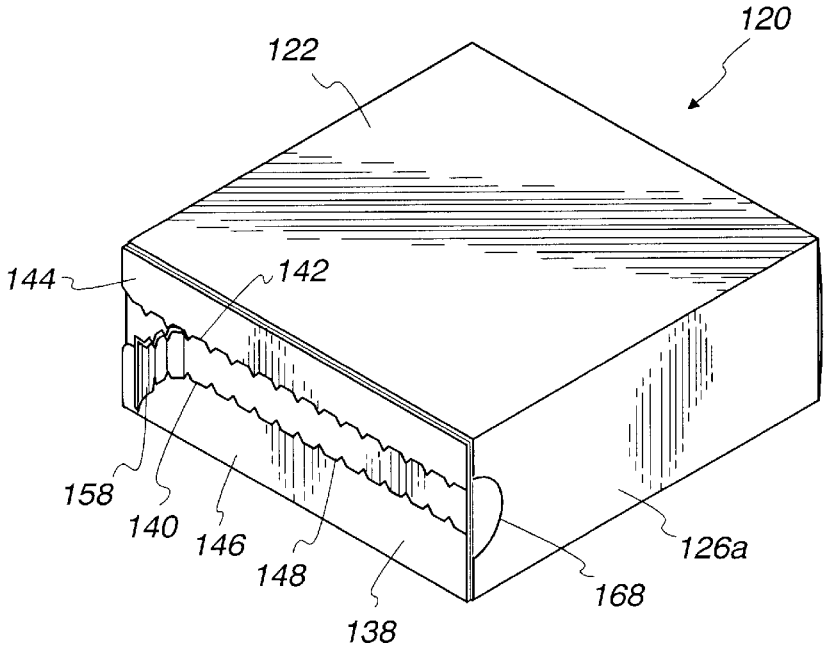
FIG. 4 is perspective view of a food container in accordance with a second embodiment of the present invention.
Figure 5:
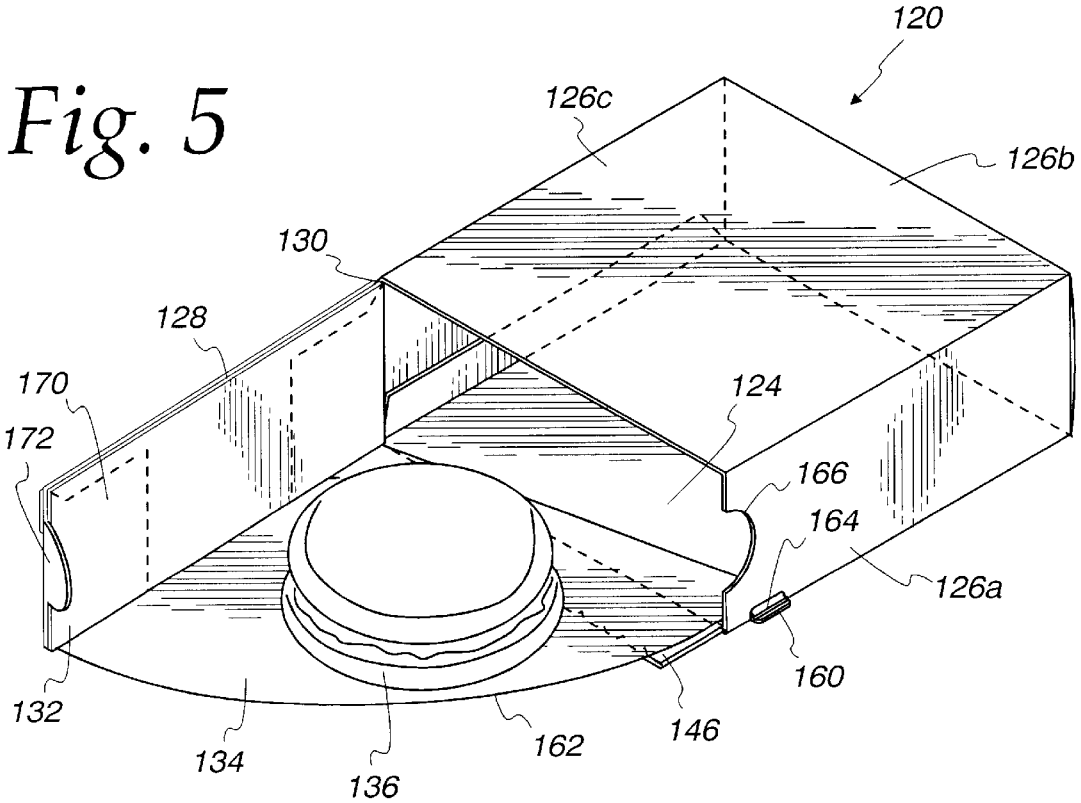
FIG. 5 is a perspective view of the container of FIG. 4 shown in an open position.

FIGS. 4 and 5 show a food container 120 that is in accordance with a second embodiment of the present invention. In FIG. 4, the container 120 is shown in the closed position; while in FIG. 5, it is shown in the open position. Food container 120 includes a generally square top panel 122 and a generally square bottom panel 124 that is substantially parallel to the top panel 122. The container 120 also includes a plurality of sidewalls 126*a–c* attached between the top and bottom panels 122, 124. A movable panel 128 is hingedly connected at an end 130 of one of the side panels. Projecting from the lower edge 132 of the movable panel 128 is a shelf 134 supporting a food item 136. The shelf 134 is slidable over the upper surface of the bottom panel 124 as the panel 128 is moved between the open and closed positions.

Joined to the bottom panel 124 is an adhering flap 138 for retaining the movable panel 128 in the closed position. The adhering flap 138 includes a pair of horizontal weakening lines 140, 142 that divide the flap 138 into an upper panel portion 144 and a lower panel portion 146 with the area between the weakening lines 140, 142 defining a horizontal tear strip 148. In constructing the container 120, adhesive is disposed upon the interior surface of the upper portion 144 to attach it to the upper exterior surface of the movable panel 128.

The sidewall 126*a* includes a finger insert 166 at its end adjoining the movable panel 128. The finger insert 166 is defined by a generally vertical weakening line 168 formed in the sidewall 126*a* between the top and bottom panels 122, 124. The weakening line 168 also defines a flange 170 having a tab 172. The flange 170 is attached to the exterior surface of the movable panel 128 using an adhesive. In constructing the container 120, the flange 170 is sandwiched between the adhering flap 138 and the movable panel 128.

The shelf 134 includes a retaining tab 160 projecting from its outer curved edge 162. As the shelf 134 is moved from the closed position into the open position, the retaining tab 160 is received by a slot 164 formed at the lower edge of the sidewall 126*a*. This arrangement prevents the shelf 134 from being easily moved beyond a position that is supported by the bottom panel 124 and lower portion 146 of the adhering flap 138.

Figure 6:
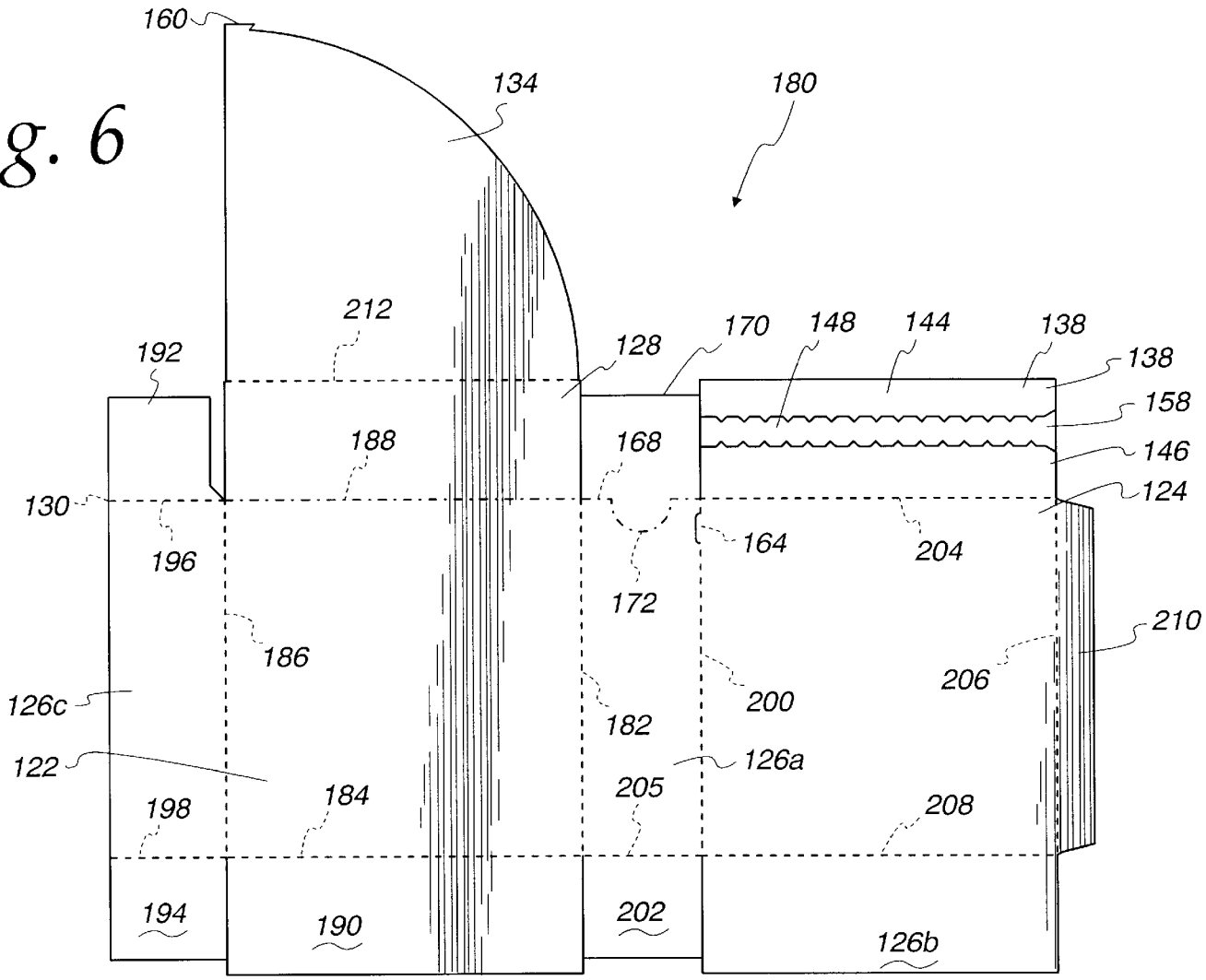
FIG. 6 is a top plan view of the blank from which the container of FIGS. 4–5 is constructed.

FIG. 6 is a top plan view of a blank sheet of material, such as cardboard, that can be folded into the container 120 shown in FIGS. 4 and 5. The top panel 122 is set off by fold lines 182, 184, 186 and a weakening line 188, imparting a generally square shape thereto. An interior sidewall 190 is joined to the top panel 122 at fold line 184. An adhesive can be disposed on the underside of the interior sidewall 190, permitting attachment to the interior surface of the back sidewall 126*b*.

The sidewall 126*c* is joined to the top panel 122 at fold line 186. Two flanges 192 and 194 are joined at the ends of the side panel 126*c* by fold lines 196, 198. Fold line 196 can be used to form a living hinge connecting the movable panel 128 to the side panel 126*c*. In constructing the container 120, adhesive is disposed on the upper surface of the flange 192 to attach it to the exterior surface of the movable panel 128, while adhesive can be used to attach the under surface of the flange 194 to the interior side of sidewall 190.

The side panel 126*a* is joined between the top panel 122 and the bottom panel 124 by fold lines 182, 200. The tabbed flange 170 is detachably joined to the side panel 126*a* by the weakening line 168. The flange 202 is joined to the opposite end of the side panel 126*a* by fold line 205. Adhesive can be disposed upon the under surfaces of the flanges 170, 202 so that they can be respectively attached to the exterior surface of the movable panel 128 and interior surface of the interior side panel 190.

The bottom panel 124 is set off by fold lines 200, 204, 206 and 208, imparting a generally square shape thereto. The side panels 126*a–b* are joined to the bottom panel 124 at fold lines 200, 208; while the adhering flap 138 is joined to the bottom panel 124 at fold line 204. A flange 210 is joined to the bottom panel 124 at fold line 206. Adhesive can be disposed on the under surface of the flange 210 so that it can be attached to the interior surface of the side panel 126*c*.

The slidable shelf 134 is joined to the movable panel 128 by perforated fold line 212. The fold line 212 includes a series of slits for weakening the fold. This reduces the tendency of the movable panel 128 to pivot downwardly about the fold line 212 when the panel 128 is released from the closed position. In turn, this allows the movable panel 128 to maintain a relatively perpendicular relationship to the shelf 134 in the open position.

The movable panel 128 is detachably joined to the top panel 122 by the weakening line 188. Accordingly, the movable panel must be detached from the top panel 122 to access the contents of the container 120.

To remove the food item 136 from the container 120, the tear strip 148 is grasped by its end 158 and a pulling force is applied to sever the strip 148 along the weakening lines 140, 142 in the manner shown in FIG. 4. Once the tear strip 148 has been removed, the lower portion 146 of the adhering flap 138 pivots downwardly as shown in FIG. 5. The lower portion 146 provides additional support under the shelf 134 as it is moved into the open position. After removing the tear strip 148, the movable panel 128 can be separated from the top panel 122. This is accomplished by rupturing the sidewall 126*a* along the weakening line 168 to define the finger insert 166. A finger is then inserted into the insert 166 to apply force against the interior surface of the movable panel 128, thereby separating the movable panel 128 from the top panel 122. The movable panel 128 axially pivots about fold line 196 to expose the food item 136 carried by the shelf 134. Similarly to the container 10 shown in FIGS. 1 and 2, the exposed food item 136 can be manipulated and then conveniently re-enclosed in the container 120.

While specific embodiments of the present invention have been shown and described, it will be apparent to those skilled in the art that the disclosed invention may be modified in numerous ways and assume many embodiments other than the preferred forms specifically set out and described above. Accordingly, it is intended by the appended claims to cover all modifications of the invention which fall within the true spirit and scope of the invention.

What is claimed is:

1. A blank foldable to form a food container having a top panel, a bottom panel, a plurality of side walls attached between the top and bottom panels, a movable panel hingedly connected to an end of one of the side walls, a side flap having a tear-off strip and being attachable to an exterior surface of the movable panel, and a movable support for carrying a food item, extending from a lower edge of the movable panel overlying the bottom panel and being slidable over the bottom panel when the movable panel is moved between opened and closed positions.

2. The blank of claim 1, wherein the food container further comprises:

a tab projecting from an outer edge of the movable support; and a slot formed in one of the side walls for receiving the tab when the movable panel is moved to the opened position.

3. The blank of claim 1, wherein the blank is foldable to form a live hinge connecting the movable panel to the end of one of the side walls.

4. The blank of claim 1, wherein the top panel is octagonally shaped.

5. The blank of claim 1, wherein the bottom panel is a polygon having a curved edge and extends substantially entirely across the width of the container in an open position.

6. The blank of claim 1, wherein the movable support is a shelf.

7. The blank of claim 1, wherein the blank is foldable so that the movable support overlies the bottom panel in frictional engagement therewith such that after initial opening and reclosing, the weight of the food item maintains the container in the closed position.

8. The blank of claim 1, wherein the movable support includes an edge portion which engages one or more of the sidewalls to aid in maintaining the container in the closed position after reclosing.

9. A microwaveable food container in combination with a microwaveable food product, comprising:

a top panel;

a bottom panel substantially parallel to the top panel;

a plurality of side walls attached to the top and bottom panels;

a movable panel hingedly connected to an end of one of the side walls; and a movable support extending from a lower edge of the movable panel overlying the bottom panel, the shelf being slidable across an upper surface of the bottom panel when the movable panel is moved between an open position and a closed position;

the food product being supported on the movable support so as to be removable from the container by moving the movable panel to the open position, and being replaceable in the container by moving the movable panel to the closed position.

10. The food container of claim 9, further comprising a tear-off strip attachable to an exterior surface of the movable panel.

11. The food container of claim 9, wherein the tear-off strip is included in a side flap extending from an edge of the top panel or the bottom panel.

12. The food container of claim 9, further including a flap extending from an end of the movable panel and attaching to an exterior surface of one of the side walls to restrain the movable panel in the closed position, the flap including a tear-off strip permitting the movable panel to be released from the closed position.

13. The food container of claim 9, further comprising a live hinge connecting the movable panel to the end of one of the sidewalls.

14. The food container of claim 9, wherein one of the side walls includes a weakening line circumscribing a finger tab attached to an end of the movable panel.

15. The food container of claim 9, wherein the top and bottom panels are rectangularly shaped.

16. The food container of claim 9, wherein the top panel is octagonally shaped.

17. The food container of claim 9, wherein the movable support is a shelf.

18. The food container of claim 9, wherein the movable support overlies the bottom panel in frictional engagement therewith so that after initial opening and reclosing, the weight of the food product maintains the movable support in the closed position.

19. The food container of claim 9, wherein the movable support includes on edge portion that engages one or more of the sidewalls to aid in maintaining the movable support in the closed position after reclosing.

* * * * *